United States Patent [19]

Southard

[11] Patent Number: 4,993,546

[45] Date of Patent: Feb. 19, 1991

[54] SELF DRAINING SOAP DISH

[76] Inventor: Stanley R. Southard, 5244 Brynwood Dr., Columbus, Ohio 43220

[21] Appl. No.: 500,536

[22] Filed: Mar. 26, 1990

[51] Int. Cl.[5] ..... A47K 5/02

[52] U.S. Cl. ..... 206/77.1; 4/628; D6/532; D6/536

[58] Field of Search ..... D6/532, 536; D28/76; 4/628, 654, 656; 206/77.1, 557

[56] References Cited

U.S. PATENT DOCUMENTS

| | | | |
|---|---|---|---|
| D. 130,579 | 12/1941 | Dreyfuss | D6/536 |
| D. 154,903 | 8/1949 | Caldwell | D6/536 |
| D. 188,453 | 7/1960 | Marcus | D6/532 |
| D. 224,028 | 6/1972 | Settle | D6/536 |
| 907,261 | 12/1908 | Martin | 4/656 |
| 1,224,838 | 5/1917 | Blissman et al. | 4/656 |
| 1,309,965 | 7/1919 | Schwab | 4/628 |
| 1,536,906 | 5/1925 | Miller | 4/628 |
| 1,728,502 | 9/1929 | McGregor | 4/656 |
| 2,896,363 | 7/1959 | Litzaw | D6/532 |
| 4,331,232 | 5/1982 | Larkin | 206/77.1 |

*Primary Examiner*—Jimmy G. Foster
*Attorney, Agent, or Firm*—Leon Gilden

[57] ABSTRACT

A soap dish construction including a planar rear wall with an integral floor and generally S-shaped sides, each of the sides includes a forward portion directed interiorly of a rear portion wherein the forward portion projects beyond and below the floor. The floor includes a tapered upper surface to direct fluid directed up to the upper surface towards the forward portion of the side walls defining a trough including a trough floor. The trough floor angulates forwardly and downwardly relative to the inclined upper surface of the floor and is generally coextensively arranged therewith. The upper surface of the floor includes a plurality of spaced ribs defined by a predetermined spacing therebetween. A modified construction of the invention includes a tool receivable within a slot within the dish construction where a tool is defined by a first leg of a width substantially equal to the predetermined spacing between the upstanding ribs.

1 Claim, 5 Drawing Sheets

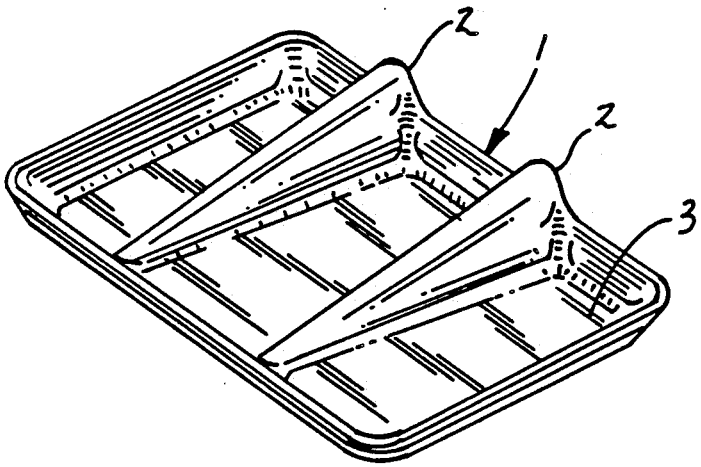
FIG 1
PRIOR ART
FIG 2
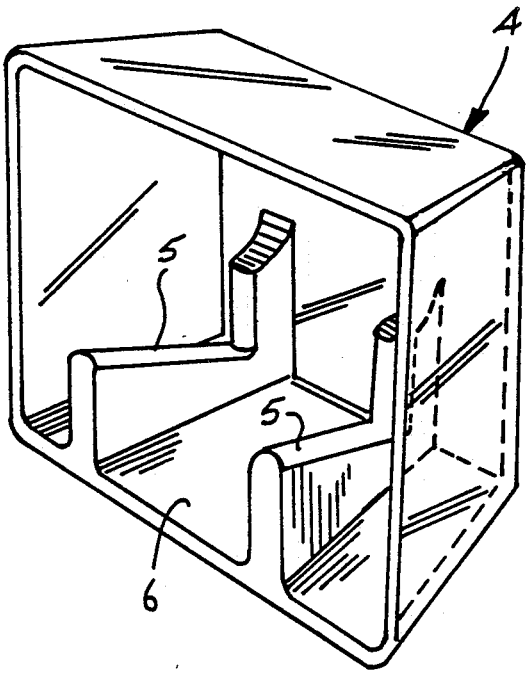
PRIOR ART

FIG 5
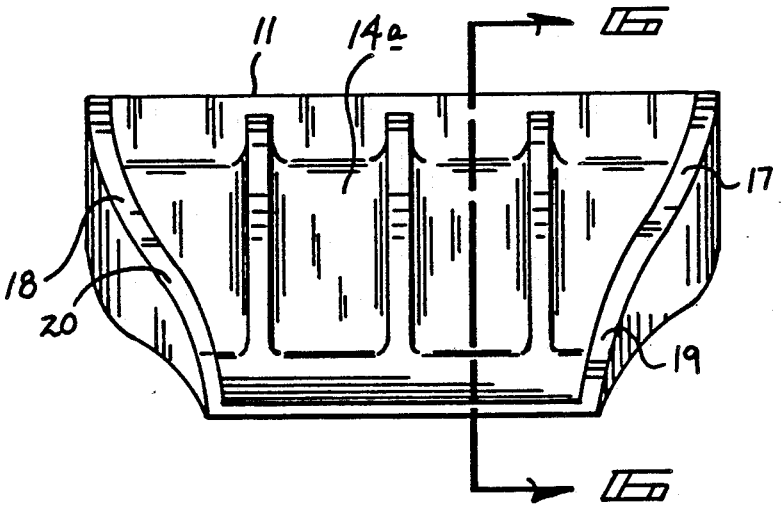
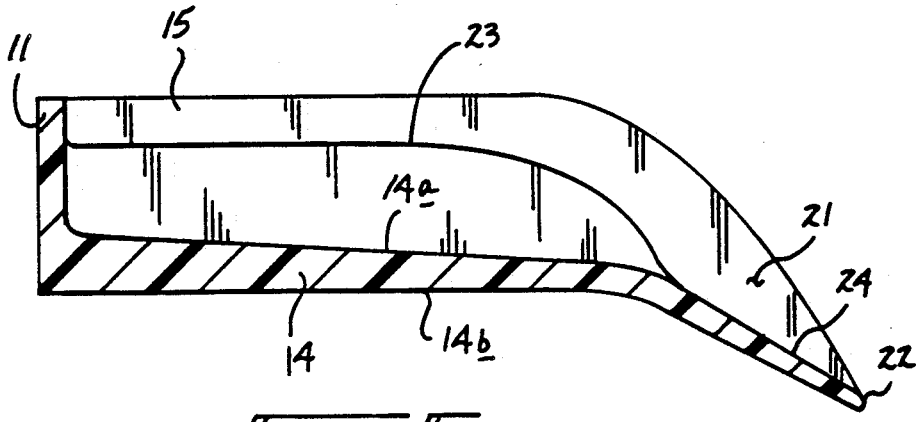
FIG 6

SELF DRAINING SOAP DISH

BACKGROUND OF THE INVENTION

1. Field of the Invention

The field of the invention relates to soap dish construction, and more particularly pertains to a new and improved soap dish construction wherein the same permits aeration and draining of the soap dish and associated soap contained therewith to minimize maintenance and cleaning thereof.

2. Description of the Prior Art

In use of soap dish, as the soap dissolves due to inherent moisture utilized in a cleansing operation, a soap film eventually a layer develops upon a lower surface of a soap dish and accordingly requires periodic cleaning and maintenance thereof. The instant invention attempts to overcome deficiences of prior art soap dish constructions by minimizing such soap buildup within a soap dish floor.

Examples of the prior are include U.S. Pat. No. 4,621,730 to MANCUSI, JR. wherein the patent sets forth a soap holder to effect aeration within the soap holder by providing flared wall construction directed forwardly of a rear wall to effect drainage of a bar of soap contained therewithin wherein the soap is typically mounted upon ribs to position the soap in a spaced relationship relative to the wall construction of the soap holder.

U.S. Pat. No. 1,479,361 to BLEVENS sets forth a soap dish provided with an elevated portion overlying a forward trough wherein fluid directed from the soap is contained within the forward trough and drained from the soap as is typical of the prior art the accumlated fluid is wholly contained within the soap dish.

U.S. Design Pat. Nos. 240,784: 293,638: 293,751 are further exemplary constructions of soap dish organizations to position a bar of soap in a elevated position relative to a soap dish floor.

As such, it may be appreciated that there continues to be a need for a new and improved self draining soap dish wherein the same addresses both the problems of ease of use as well as effectiveness in construction and positioning a bar of soap above a soap dish floor and providing continuous drainage of the soap during its securement within the soap dish of the instant invention and as such, the present invention substantially fulfills this need.

SUMMARY OF THE INVENTION

In view of the foregoing disadvantages inherent in the known types of soap dish constructions present in the prior art, the present invention provides a new and improved self draining soap dish wherein the same provides a forward trough within the soap dish in communication with a sink basin of an associated sink to permit continuous and automatic drainage of the soap dish in use. As such, the general purpose of the present invention, which will be described subsequently in greater detail, is to provide a new and improved self draining soap dish which has all the advantages of the prior art soap dish organizations and none of the disadvantages.

To attain this, the self draining soap dish of the invention includes a soap dish construction including a planar rear wall with an integral floor and generally S-shaped sides, each of the sides includes a forward portion directed interiorly of a rear portion wherein the forward portion projects beyond and below the floor. The floor includes a tapered upper surface to direct fluid directed up to the upper surface towards the forward portion of the side walls defining a trough including a trough floor. The trough floor angulates forwardly and downwardly relative to the inclined upper surface of the floor and is generally coextensively arranged therewith. The upper surface of the floor includes a plurality of spaced ribs defined by a predetermined spacing therebetween. A modified construction of the invention includes a tool recievable within a slot within the dish construction where a tool is defined by a first leg of a width substantially equal to the predetermined spacing between the upstanding ribs.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self draining soap dish which has all the advantages of the prior art self draining soap dish and none of the disadvantages.

It is another object of the present invention to provide a new and improved self draining soap dish which may be easily and efficiently manufactured and marketed.

It is a further object of the present invention to provide a new and improved self draining soap dish which is of a durable and reliable construction.

An even further object of the present invention is to provide a new and improved self draining soap dish which is susceptible of a low cost of manufacture with regard to both materials and labor, and which accordingly is then susceptible of low prices of sale to the consuming public, thereby making such self draining soap dishes economically available to the buying public.

Still yet another object of the present invention is to provide a new and improved self draining soap dish which provides in the apparatuses and methods of the prior art some of the advantages thereof, while simultaneously overcoming some of the disadvantages normally associated therewith.

Still another object of the present invention is to provide a new and improved self draining soap dish which may be compactly stored when not being utilized.

Yet another object of the present invention is to provide a new and improved self draining soap dish wherein the same conveniently and automatically directs excess fluid from a soap bar into an associated sink basin minimizing maintenance and cleaning of the soap dish.

These together with other objects of the invention, along with the various features of novelty which characterize the invention, are pointed out with particularily in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art soap dish.

FIG. 2 is an isometric illustration of a further example of a prior art soap dish.

FIG. 5 is a frontal orthographic view taken in elevation of the instant invention.

FIG. 6 is an orthographic view taken along the lines 6—6 of FIG. 5 in the direction indicated by the arrows.

DESCRIPTION OF THE PREFERRED EMBODIMENT

Figure 3:
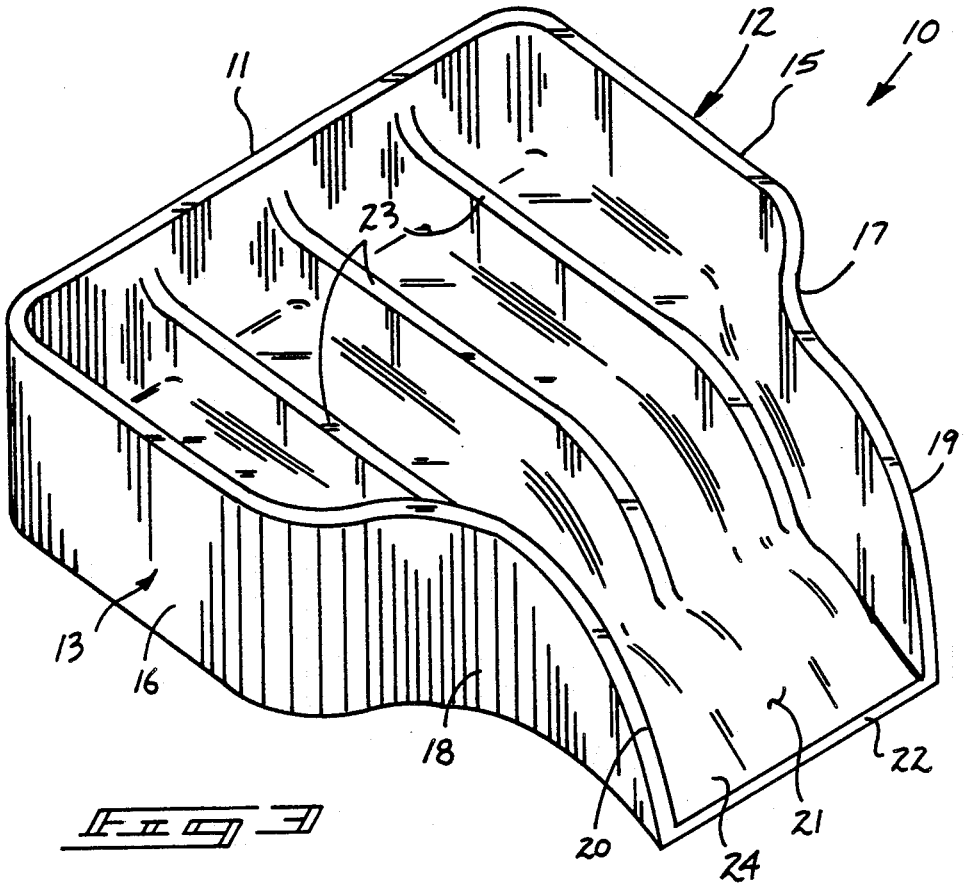
FIG. 3 is an isometric illustration of the instant invention.
Figure 4:
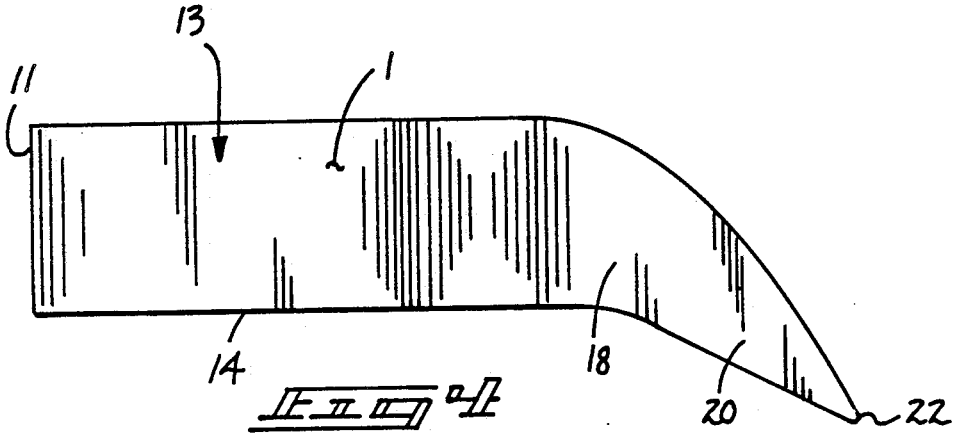
FIG. 4 is an orthographic side view taken in elevation of the instant invention.

With reference now to the drawings, and in particular to FIGS. 1 to 11 thereof, a new and improved self draining soap dish embodying the principles and concepts of the present invention and generally designated by the reference numerals 10 and 10*a* will be described.

FIG. 1 illustrates a prior art soap dish 1 including a plurality of ribs 2 angulated downwardly towards a soap dish floor 3 of the associated soap dish container to permit drainage of an associated bar of soap within the soap dish. FIG. 2 illustrates a further example of a prior art soap dish construction 4 wherein outwardly splayed walls of the soap dish 4 direct fluid exteriorly thereof wherein a downwardly tapered floor 6 includes upstanding ribs 5 to direct fluid from the soap dish exteriorly thereof.

More specifically, the self draining soap dish 10 of the instant invention essentially comprises a dish including a planar rear wall 11 orthogonally mounted to a right side wall 12 and a left side wall 13 wherein the right and left side walls are generally S-shaped configuration integrally mounted to the planar rear wall at their rear terminal ends and directed forwardly thereof. A floor web 14 is coextensively mounted between lower edges of the rear wall 11 and respective right and left planar side wall rear portions 15 and 16. The planar right and left side wall rear portions 15 and 16 include respective right and left side wall concave medial portions 17 and 18 that further includes and are coextensively directed into right and left side wall respective forward portions 19 and 20. The forward portions 19 and 20 extend beyond and below the floor web 14 as illustrated. A planar trough floor 24 is angulated downwardly and forwardly of the floor web 14 and defines an obtuse included angle between the floor web bottom surface 14*b* which is defined as a planar surface as illustrated in FIG. 6 for example. The floor web 14 includes an inclined top surface 14*a* that is directed downwardly towards the planar trough floor 24.

The trough floor 24 terminates in a forward edge 22 that is arranged generally parallel to the rear wall 11. Accordingly the right and left forward portions 19 and 20 in association with the planar trough floor 24 defined a trough 21 to direct fluid developed within the dish 10 to empty within an associated sink basin 25 wherein the planar bottom surface 14*b* is accordingly mounted upon the planar sink table 26 that is typically formed in surrounding relationship relatives to the sink basin 25. A series of parallel ribs 23 are integrally and orthogonally mounted to the inclined top surface 14*a* and directed upwardly thereof and include a spacing therebetween defined by a predetermined spacing. In this manner, a bar of soap mounted upon upper edges of the ribs 23 directs fluid onto the inclined top surface 14*a* then in turn directs the fluid into the downwardly directed planar trough 424 of the associated trough 21 to conveniently direct such fluid within the sink basin 25.

Figures 7, 8:
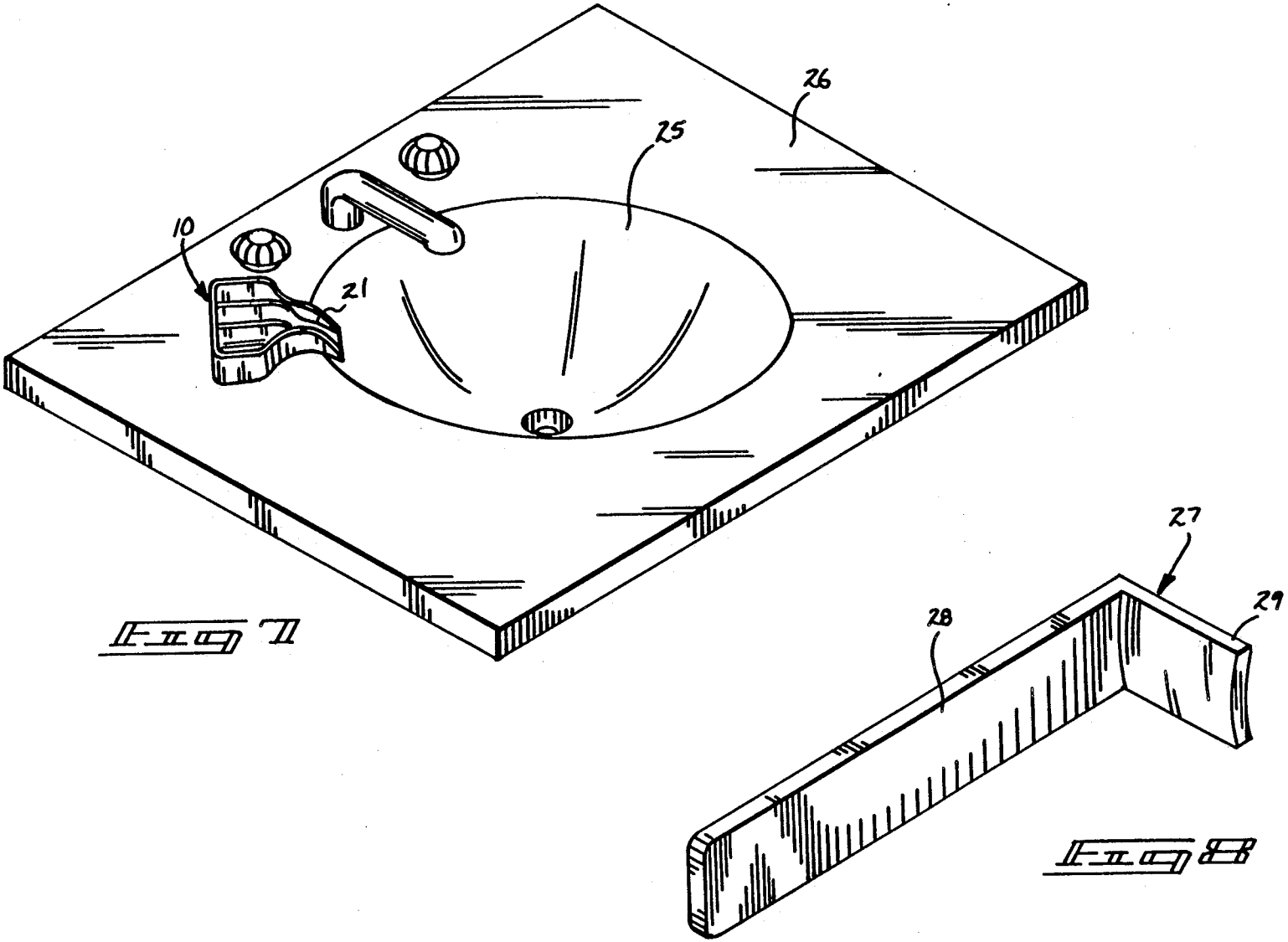
FIG. 7 is an isometric illustration in use in association with a sink basin.
FIG. 8 is an isometric illustration of a tool utilized by a modification of the instant invention.
Figure 9:
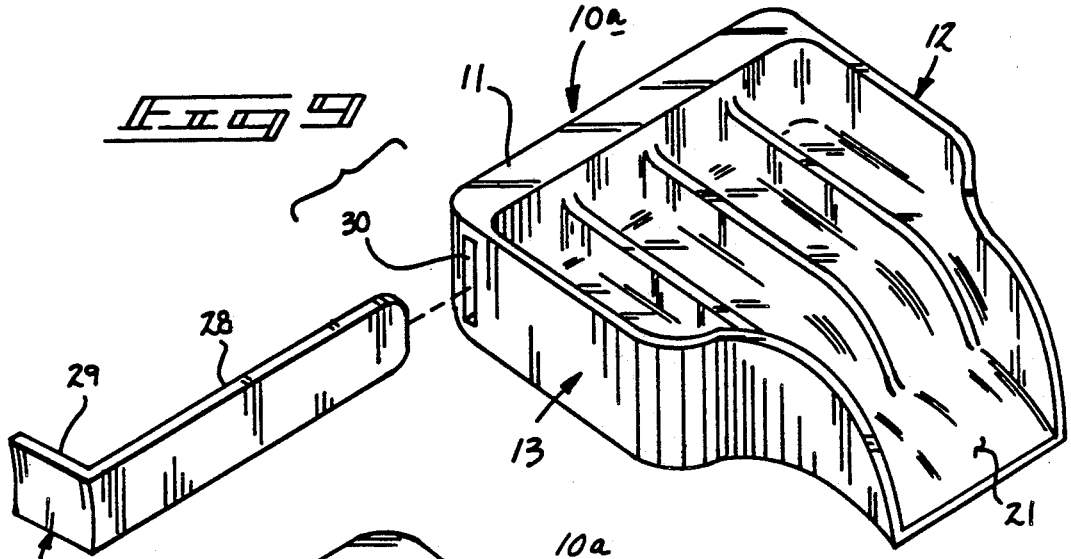
FIG. 9 is an isometric illustration of a modification of the instant invention.
Figure 10:
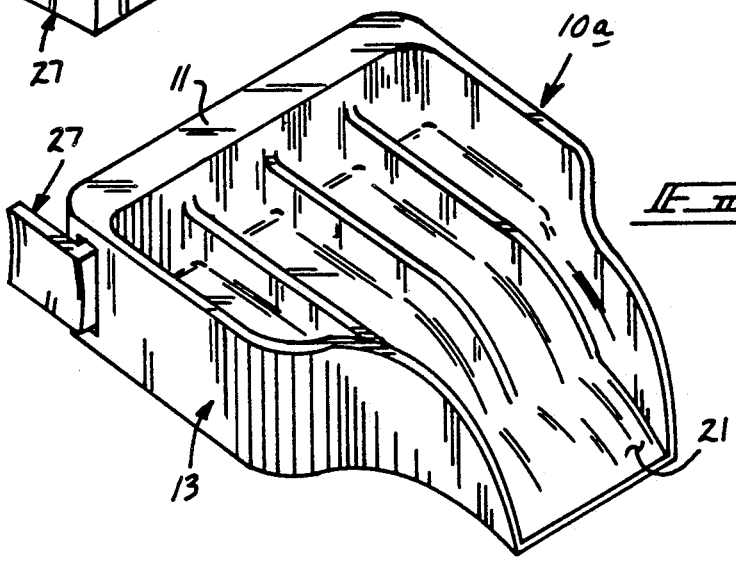
FIG. 10 is an isometric illustration of the modification of the instant invention with the tool positioned in an associated slot.
Figure 11:
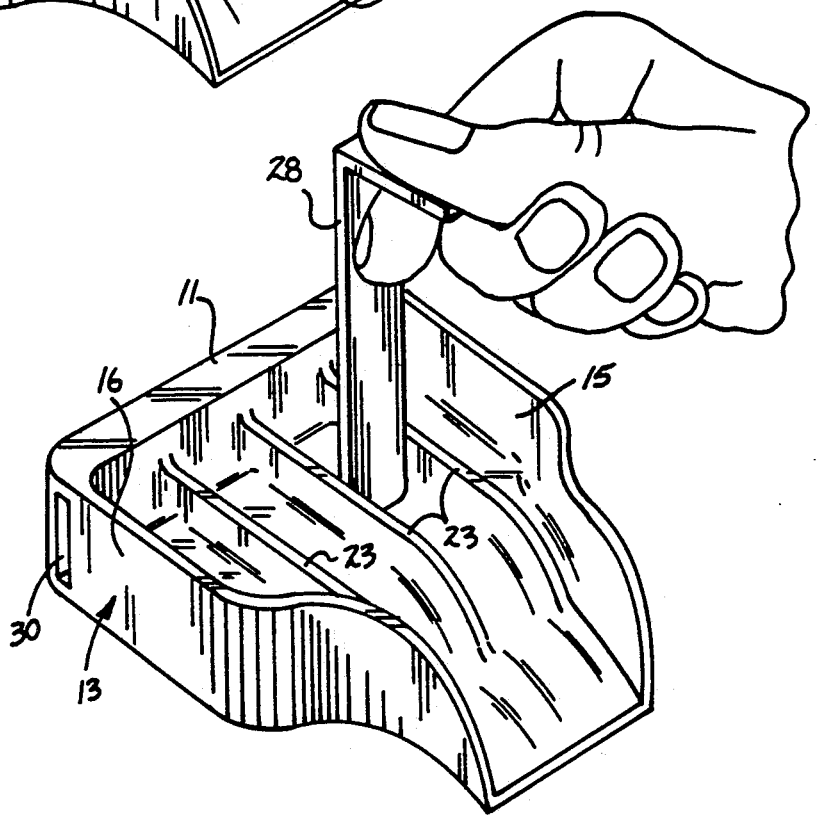
FIG. 11 is an isometric illustration of the tool utilized by the modification of the instant invention in use.

FIGS. 8 through 11 illustrate the use of a modified self draining soap dish organization 10*a* (see FIGS. 9, 10, and 11) utilizing a cleaning tool 27. The cleaning tool 27 as illustrated in FIG. 8 for example includes a first longitudinally aligned planar first leg 28 defined by a width substantially equal to the predetermined spacing between the ribs 23. A second leg 29 is orthogonally directed and integrally mounted to an upper terminal end of the first leg 28 to define a handle 29. The first leg 28 is received within an elongate sleeve 31 formed longitudinally aligned with and formed internally of the rear wall 11 and formed coextensively therewith and wherein the sleeve 30 is defined by a length substantially equal to a predetermined length equal to a length defined by the first leg 28. In this manner, the first leg 28 of the tool 27 (see FIG. 11) is directed between the ribs 23 and directed across the top surface 14*a* to effect cleaning and dislodging of any soap residue contained therebetween.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired and to be protected by Letters Patent of the United States is as follows:

1. A self draining soap dish comprising, a floor web, the floor web including a planar rear wall mounted orthogonally and upwardly relative to rear edge of the floor web, and the dish further including a right and left side wall wherein the right and left side walls are arranged parallel to one another and orthogonally mounted to the rear wall at rear terminal ends of each respective side wall, and the right and left side walls including respective right and left forward ends wherein the right and left forwards ends extend beyond the floor web, and wherein the right and left side walls are of a generally "S" shaped configuration and the floor web includes a planar bottom surface underlying an inclined top surface, the inclined top surface angulated downwardly towards the right and left forward ends of the respective right and left side walls, and wherein the right and left side walls define a trough extending beyond and below the planar bottom surface of the floor web, and wherein the trough includes a planar trough floor wherein the planar trough floor defines an obtuse included angle between the planar trough floor and the planar bottom surface of the floor web, and wherein the right side wall includes a right planar rear portion and the left side wall includes a left planar rear portion wherein the right and left rear portions are arranged parallel to one another and are coextensive with the floor web, and the left and right side walls further including a respective right and left concave medial portion wherein the concave medial portions are spaced interiorly of the respective right and left side walls, and the concave right and left medial portions extend forwardly and downwardly relative to the floor web including right and left forward portions, the right and left forward portions include the planar trough floor fixedly mounted therebetween, and wherein the inclined top surface of the floor web includes a series of ribs, the ribs arranged parallel to one another and spaced apart a predetermined spacing, and wherein the trough floor extends forwardly and below the planar bottom surface of the floor web terminating in a trough forward edge, the trough forward edge arranged parallel to and below the planar rear wall, and wherein the planar rear wall includes an elongate sleeve longitudinally arranged and positioned within the planar rear wall, the sleeve defined by a predetermined length, and further including a cleaning tool, the cleaning tool including a first rigid leg wherein the first rigid leg is defined by a width substantially equal to the predetermined spacing and is defined by a length equal to the predetermined length of the sleeve, and the cleaning tool includes a second leg defining a handle orthogonally mounted to an upper terminal end of the first leg, and the sleeve receives the first leg complimentarily therewithin and selectively permits removal of the cleaning tool to permit directing of a lower terminal end of the first leg between the ribs to permit cleaning therebetween.

* * * * *